US006433651B1

(12) United States Patent
Kuroda et al.

(10) Patent No.: US 6,433,651 B1
(45) Date of Patent: Aug. 13, 2002

(54) DIELECTRIC FILTER, COMPOSITE DIELECTRIC FILTER, DUPLEXER, AND COMMUNICATION APPARATUS HAVING RESONANCE-LINE HOLES WITH OFFSET STEPS

(75) Inventors: Katsuhito Kuroda, Matsuto; Jinsei Ishihara, Kanazawa; Hideyuki Kato, Ishikawa-ken, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/394,239

(22) Filed: Sep. 13, 1999

(30) Foreign Application Priority Data

Sep. 11, 1998 (JP) ..... 10-258624

(51) Int. Cl.[7] ..... H01P 1/213; H01P 1/205
(52) U.S. Cl. ..... 333/134; 333/202; 333/206
(58) Field of Search ..... 333/206, 222, 333/202, 134

(56) References Cited

U.S. PATENT DOCUMENTS 5,612,654 A 3/1997 Tsujiguchi et al. ..... 333/202
6,150,905 A 11/2000 Nishijima ..... 333/206

FOREIGN PATENT DOCUMENTS

EP 0853349 7/1998
JP 3108801 5/1991

OTHER PUBLICATIONS

Patent Abstracts of Japan, vol. 1998, No. 9, Jul. 31, 1998, JP 10 098302 A (Sanyo Electric Co. Ltd.) , Apr. 14, 1998—abstract in English.
Patent Abstracts of Japan, vol. 14, No. 288 (E–943), Jun. 21, 1990, JP 02 092001 A (Murata Mfg. Co. Ltd.), Mar. 30, 1990—abstract in English.
Patent Abstracts of Japan, vol. 15, No. 304 (E–1096), Aug. 5, 1991, JP 03 108801 A (Fuji Electrochem Co. Ltd.), May, 9, 1991—abstract in English.

*Primary Examiner*—Benny Lee
(74) *Attorney, Agent, or Firm*—Ostrolenk, Faber, Gerb & Soffen, LLP

(57) ABSTRACT

There is provided a dielectric filter comprising: a dielectric block; a plurality of resonance-line holes aligned therein; a resonance line disposed on an inner surface of each of the resonance-line holes; and an outer conductor disposed on an outer surface of the dielectric block; wherein one end of the resonance-line hole is a short-circuited end; a sectional area of at least one of the resonance-line holes is changed at a predetermined portion; the predetermined portion of at least one of the resonance-line holes along to the axial direction of the resonance-line hole and at a side opposed to the adjacent resonance-line hole. According to the above structure, the coupling between specified resonance lines among the adjacent resonance lines can be independently determined without changing a pitch for aligning the resonance-line holes.

20 Claims, 7 Drawing Sheets

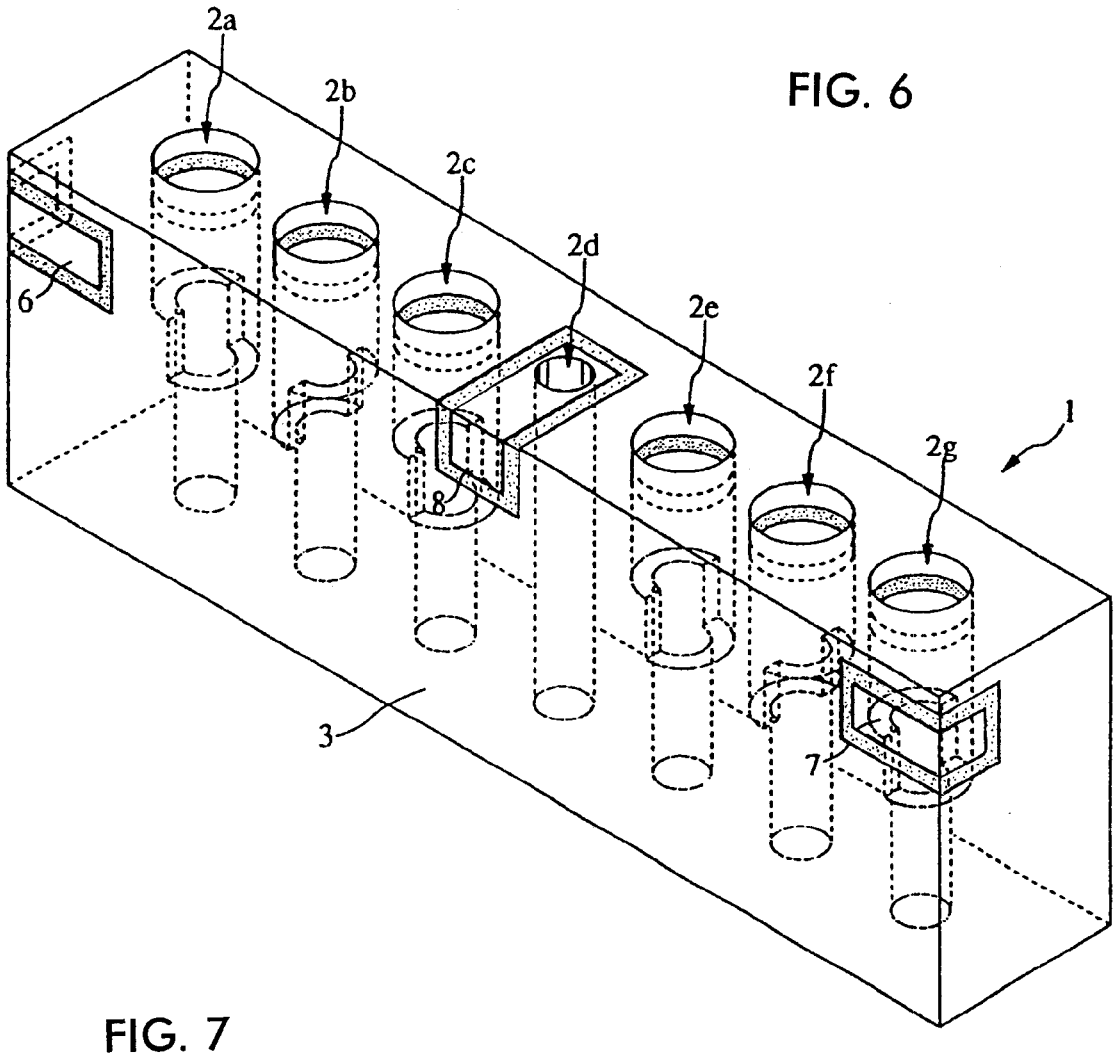
FIG. 6
FIG. 7
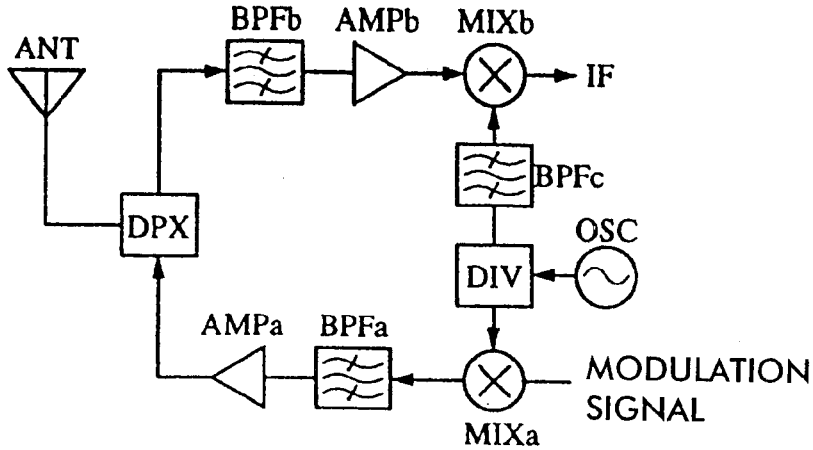

DIELECTRIC FILTER, COMPOSITE DIELECTRIC FILTER, DUPLEXER, AND COMMUNICATION APPARATUS HAVING RESONANCE-LINE HOLES WITH OFFSET STEPS

BACKGROUND OF THE INVENTION

1. Field of the Invention

The present invention relates to a dielectric filter, a composite dielectric filter, and a communication apparatus including the same, for use in a high-frequency band.

2. Related Art

FIG. 8 shows a structure of a dielectric filter using a dielectric block, which is mainly used in the micro-wave band. In FIG. 8, reference numeral 1 indicates a dielectric block of a rectangular parallelepiped configuration. Inside of the dielectric block 1, resonance-line holes indicated by 2*a*, 2*b* and 2*c*, are disposed, and inside the inner surface of each hole, an inner conductor is disposed to form a resonance line. On an outer surface of the dielectric block 1, a ground electrode 3 is disposed, and terminal electrodes 6 and 7 are disposed such that they are insulated from the ground electrode 3.

In FIG. 8, the resonance lines respectively disposed on the inner surfaces of the resonance-line holes 2*a*, 2*b*, and 2*c* make comb-line couplings in sequence, and the terminal electrodes 6 and 7 make a capacitive coupling to the resonance lines formed on the inner surfaces of the resonance-line holes 2*a* and 2*c*. In this way, a dielectric filter having a band pass characteristics of three-stage resonators is provided.

In a prior art dielectric filter shown in FIG. 8, however, it is difficult to make the coupling between specified adjacent resonance lines of the aligned plural resonance lines different from the coupling between the other resonance lines. For example, the strength of coupling cannot be changed by changing the position (the step position) where the inner diameter of a resonance-line hole 2 is changed. In a sectional view shown in FIG. 9A, for example, when the depth Lo of a step position (the depth from the end face of the dielectric block on the open-end side) is increased while maintaining a uniform pitch Po for aligning the resonance-line holes 2*a*, 2*b*, and 2*c*. the capacitive coupling between the adjacent resonance lines is strengthened. Additionally, if the pitch mentioned above is kept uniform and the only change is to make the step positions of the resonance-line holes 2*b* and 2*c* lower, the capacitive coupling between the resonance lines of the resonance-line holes 2*a* and 2*b* is strengthened. As a result, for example, as shown in FIG. 9B, in order to strengthen the coupling between the resonance lines formed in the resonance-line holes 2*b* and 2*c* without changing the coupling between the resonance lines formed in the resonance-line holes 2*a* and 2*b*, it is necessary to make a design for lowering down the step position L1 and making the pitch P1 between the resonance-line holes 2*a*–2*b* wider than Po. Consequently, the dielectric block and the dielectric filter overall are thereby made larger in size.

SUMMARY OF THE PRESENT INVENTION

To overcome the above described problems, preferred embodiments of the present invention provide a dielectric filter, a composite dielectric filter, and a communication apparatus including the same, in which the coupling between specified resonance lines among the adjacent resonance lines can be independently determined without changing a pitch for aligning the resonance-line holes.

One preferred embodiment of the present invention provides dielectric filter comprising: a dielectric block; a plurality of resonance-line holes aligned therein; a resonance line disposed on an inner surface of each of the resonance-line holes; and an outer conductor disposed on an outer surface of the dielectric block; wherein one end of the resonance-line hole is a short-circuited end; a sectional area of at least one of the resonance-line holes is changed at a predetermined portion; the predetermined portion of at least one of the resonance-line holes is set to be different from that of the other of the resonance-line holes along to the axial direction of the resonance-line hole and at a side opposed to the adjacent resonance-line hole.

According to the above described arrangement and structure, the coupling between a specified resonance line and the adjacent resonance line on the left side of the specified resonance line can be strengthened, while the coupling between the specified resonance line and the adjacent resonance line on the right side of the specified resonance line can be weakened, without changing the pitch for aligning the resonance-line holes, for example.

Accordingly, the pitch for aligning the resonance-line holes can set to be uniform, so that a molding metal die for making a resonance-line hole with respect to the dielectric block can also be used commonly in the case of formation of a dielectric filter having a different characteristic. Further, without increasing the size of the dielectric block, a compact dielectric filter having a desired characteristic can be obtained.

In the above described dielectric filter, the surface of the part where the sectional area of the resonance-line hole is changed may be set to be inclined to the axis direction of the resonance-line hole. This structure permits the molding metal die of the dielectric block to be easily produced. In addition, when a resonance-line hole is formed in the dielectric block by cutting processing, the production can be easily conducted.

Furthermore, in another preferred embodiments, three or more signal input-output terminals are disposed on a dielectric block for performing input and output of signals by coupling to specified resonance lines of a plurality of resonance lines so as to form, for example, a composite dielectric filter such as a duplexer, a diplexer, or a multiplexer.

Furthermore, the dielectric filter or the composite dielectric filter according to the present invention is used as at least one of a transmission filter and a reception filter so as to form an antenna duplexer having a transmission signal input unit, a reception signal output unit, and an antenna connection unit.

Furthermore, the dielectric filter or the composite dielectric filter according to the present invention is disposed in a high-frequency circuit section. This arrangement permits a compact and lightweight communication apparatus to be obtained.

Other features and advantages of the present invention will become apparent from the following description of embodiments of the invention which refers to the accompanying drawings, in which like reference labels denote like elements and parts and redundant description of reference labels is therefore unnecessary.

BRIEF DESCRIPTION OF DRAWINGS

FIGS. 5A and 56 show a perspective view and sectional view of a dielectric filter according to a fifth preferred embodiment of the present invention.

FIG. 6 show a perspective view of a duplexer according to a sixth preferred embodiment of the present invention.

FIG. 7 is a block diagram of a structure of a communication apparatus.

DESCRIPTION OF THE PREFERRED EMBODIMENTS

Figure 1A:
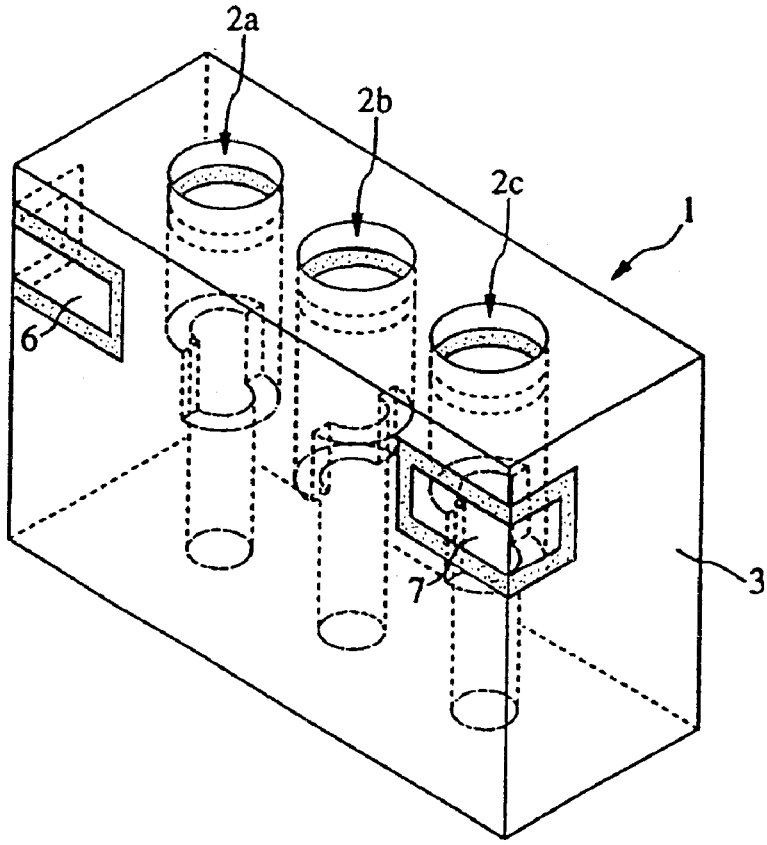
FIGS. 1A and 1B show a perspective view and sectional view of a dielectric filter according to a first preferred embodiment of the present invention.
Figure 1B:
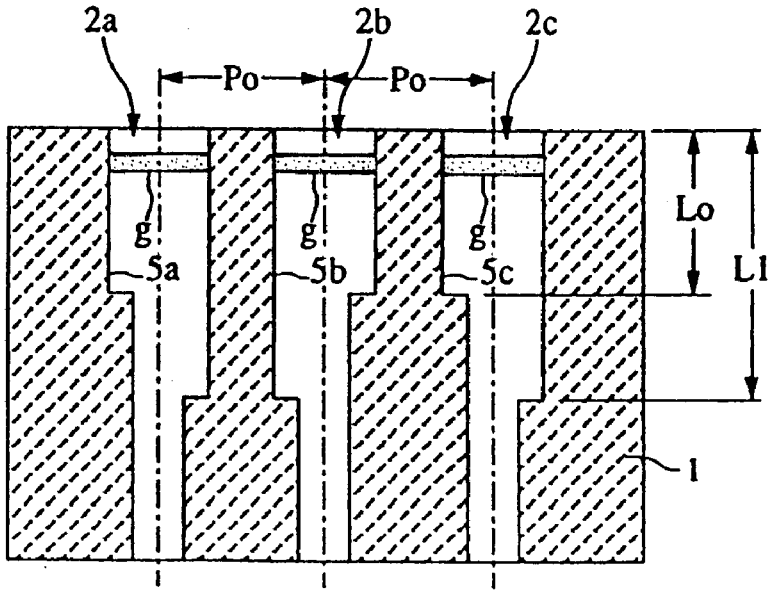

Referring to FIGS. 1A and 1B, a description will be given of a dielectric filter according to a first preferred embodiment of the present invention.

It is noted that the left-front surface shown in FIG. 1A is a mounted surface with respect to a circuit board.

In this dielectric filter, holes of specified configurations and an electrode are formed with respect to a dielectric block 1 of a rectangular parallelepiped configuration. That is, 2*a*, 2*b* and 2*c* are resonance-line holes, and on the inner surface of the resonance-line holes are formed resonance lines 5*a*, 5*b*, and 5*c*, respectively, as shown in FIG. 1B. A nonconductive portion indicated by g (FIG. 1B) is provided at a part of the resonance lines to use the part as an open end. Additionally, on an outer surface of the dielectric block 1, terminal electrodes 6 and 7, and a ground electrode 3 are provided (FIG. 1A). The resonance-line holes 2*a*, 2*b*, and 2*c* are step holes in which the inner diameter of the resonance-line holes is large at the open-end side and small at the short-circuited end (the bottom side shown in the figure). However, the step positions are not uniform. In this example, the depth of the step position on the opposing sides between the resonance lines 5*a*–5*b* is set as L1, whereas the depth of the step position on the opposing sides between the resonance lines 5*b*–5*c* is set as Lo (FIG. 1B). With this structure, although the pitch Po (FIG. 1B) for aligning the resonance lines 5*a*–5*b*–5*c* is uniform, the capacitive coupling between the resonance lines 5*a*–5*b* increases, whereas the capacitive coupling between the resonance lines 5*b*–5*c* decreases.

The terminal electrodes 6 and 7 make capacitive couplings to the resonance lines 5*a* and 5*c*, respectively. This arrangement forms a dielectric filter formed of three-stage resonators, which has a band pass characteristic.

Since the depth of the step position in the left-half part of the resonance-line hole 2*a* shown in FIG. 1 does not give much influence on the capacitive coupling to the terminal electrode 6, the depth of the step position may be L1 and a step hole having no step difference can be used. Similarly, in the resonance-line hole 2*c*, the depth of the step position may be Lo and a step hole having no step difference can be used.

Figure 2:
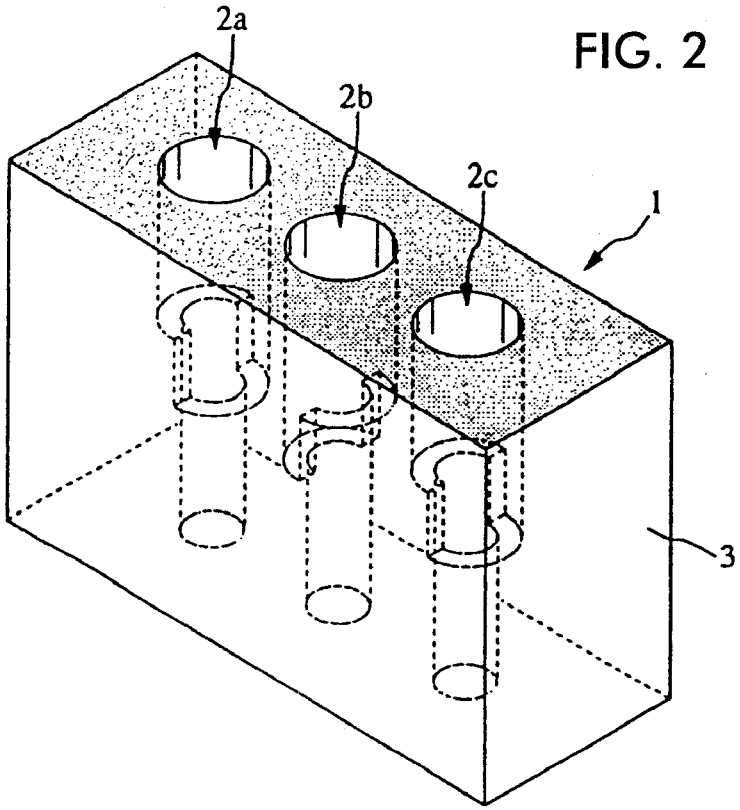
FIG. 2 shows a perspective view of a dielectric filter according to a second preferred embodiment of the present invention.

Next, a structure of a dielectric filter according to a second preferred embodiment will be described referring to FIG. 2.

In the example shown in FIGS. 1A and 1B, the open end of the resonance line is disposed inside the resonance-line hole and, the ground electrode 3 is provided on the substantially entire area of the outer surfaces of the dielectric block. In an example shown in FIG. 2, however, without providing a ground electrode, the upper surface shown in the figure is used as an open surface. Even in this case, the strength of the coupling between the adjacent resonance lines can be independently determined by independently determining the step position of the resonance-line hole on the side opposing an adjacent resonance line. In FIG. 2, external coupling units, such as the terminal electrodes 6 and 7 shown in FIG. 1, are omitted. This is also the same as in each figure, which will be shown below.

Figure 3:
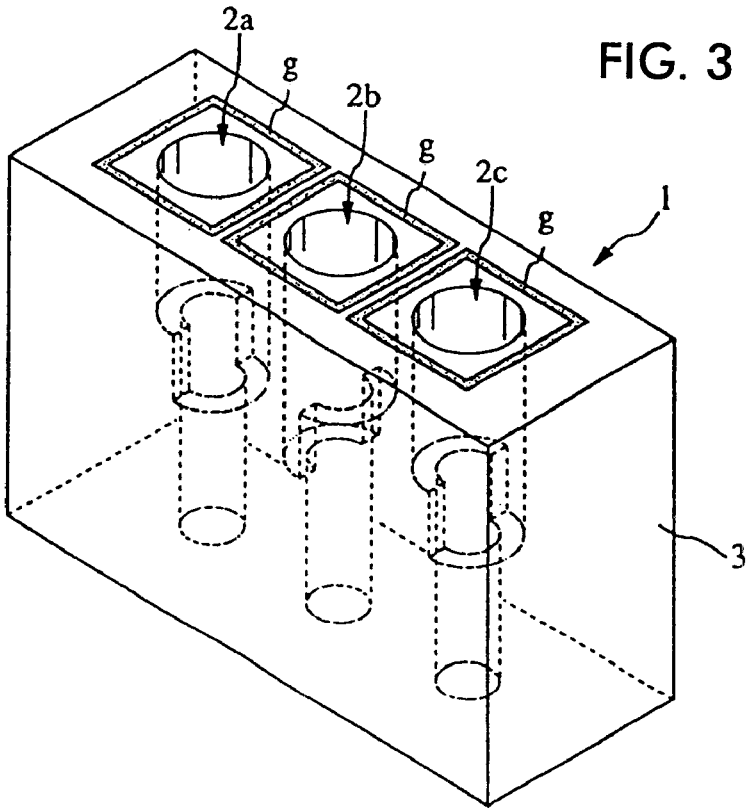
FIG. 3 shows a perspective view of a dielectric filter according to a third preferred embodiment of the present invention.

FIG. 3 is a perspective view of a dielectric filter according to a third preferred embodiment. In the embodiment shown in FIG. 1, the open end of the resonance line is disposed inside the resonance-line hole. However, as shown in FIG. 3, the resonance line may be extended to the end face of the dielectric block, on which an nonconductive portion g may be disposed.

Figure 4A:
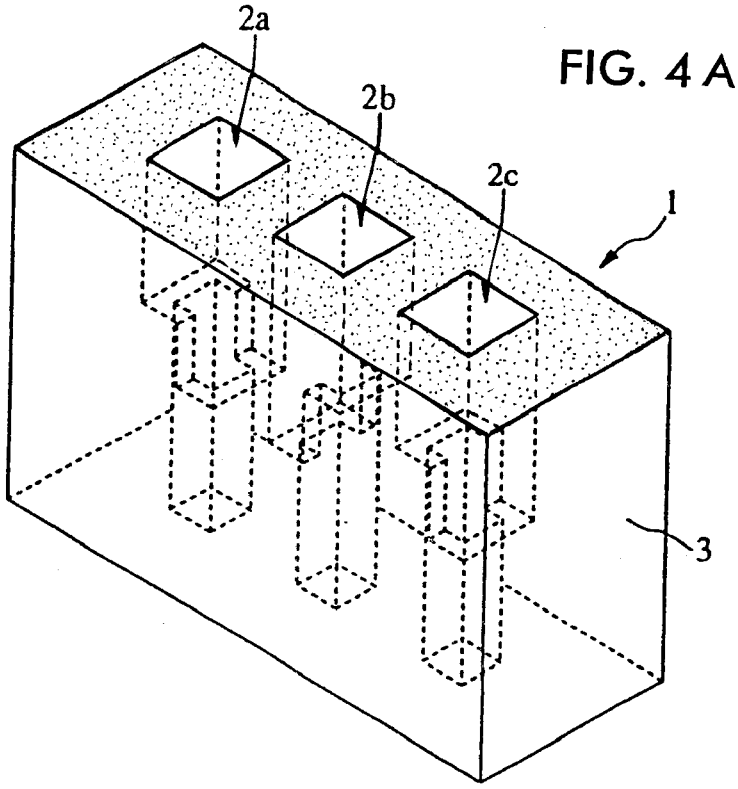
FIGS. 4A and 4B show perspective views of a dielectric filter according to a fourth preferred embodiment of the present invention.
Figure 4B:
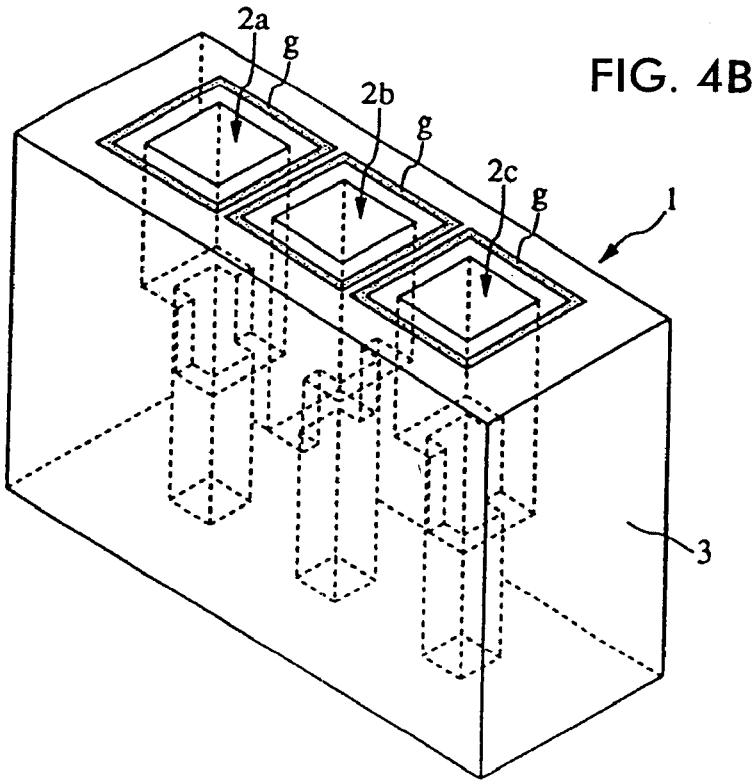

FIGS. 4A and 4B are perspective views of a dielectric filter according to a fourth preferred embodiment. In the dielectric filter shown above, the sectional configuration of the resonance-line holes is circular. However, as shown in FIGS. 4A and 4B, the sectional configuration may be rectangular, or may be even polygonal. FIG. 4A is an embodiment in which the upper surface of the dielectric block 1 shown in the figure is used as an open face, and FIG. 4B is an embodiment in which the nonconductive portion g is disposed on the upper surface of the dielectric block shown in the figure. It is not necessary to make the sectional configurations of the wider side and the narrow side of the resonance-line hole similar. One of them may be circular, and the other one may be oval or oblong.

Figure 5A:
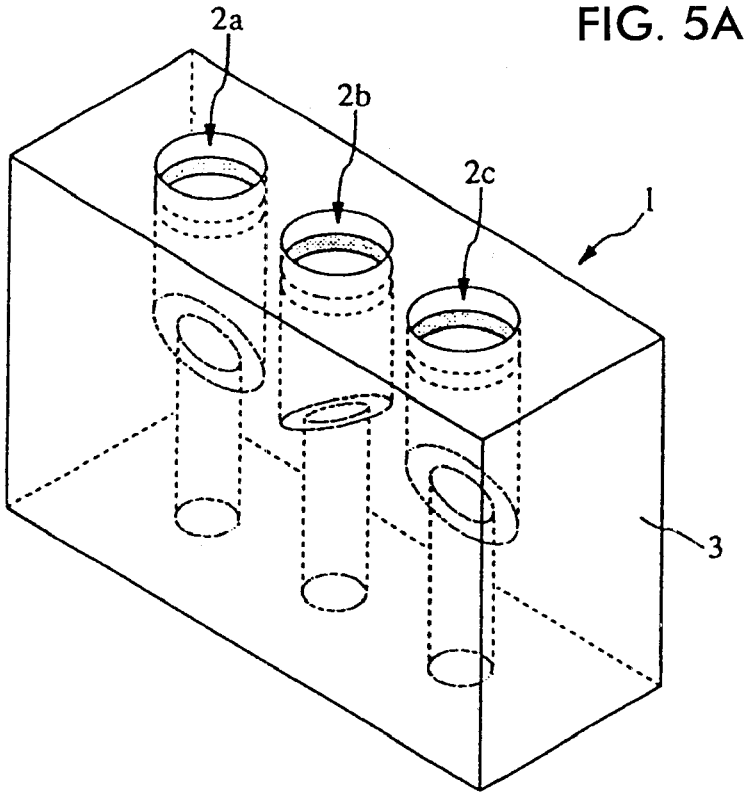
Figure 5B:
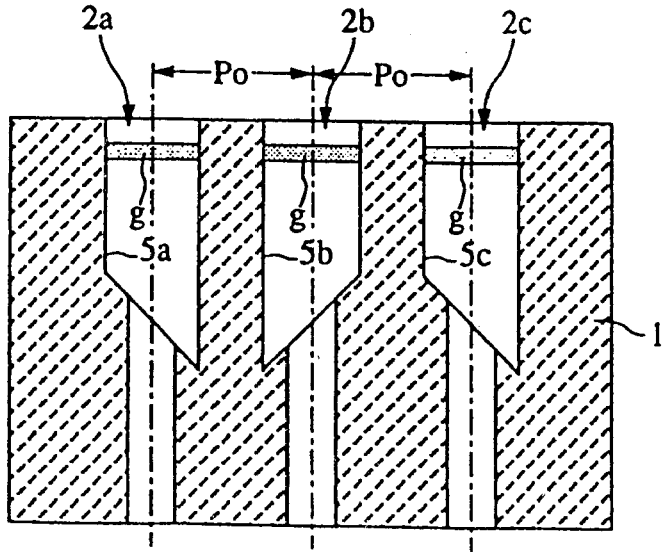
Figure 8:
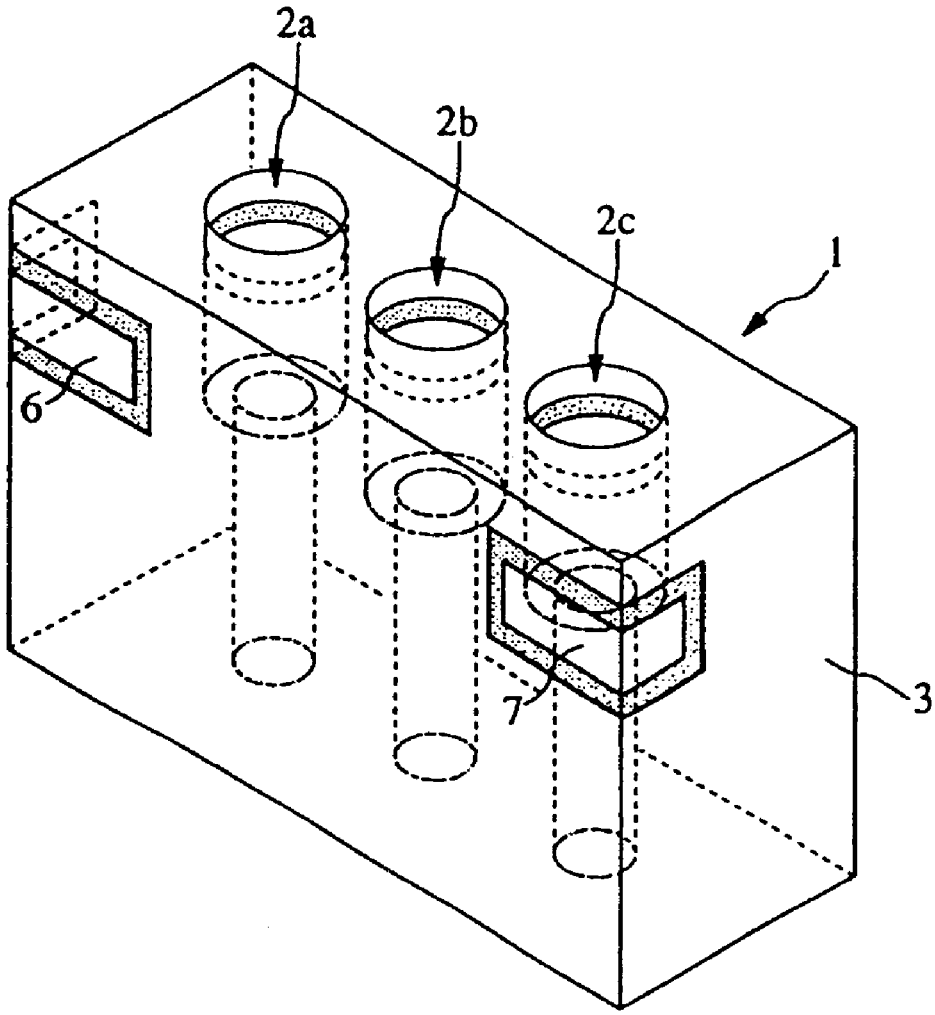
FIG. 8 PRIOR ART
FIG. 8 shows a perspective view of a prior art dielectric filter.
Figure 9A:
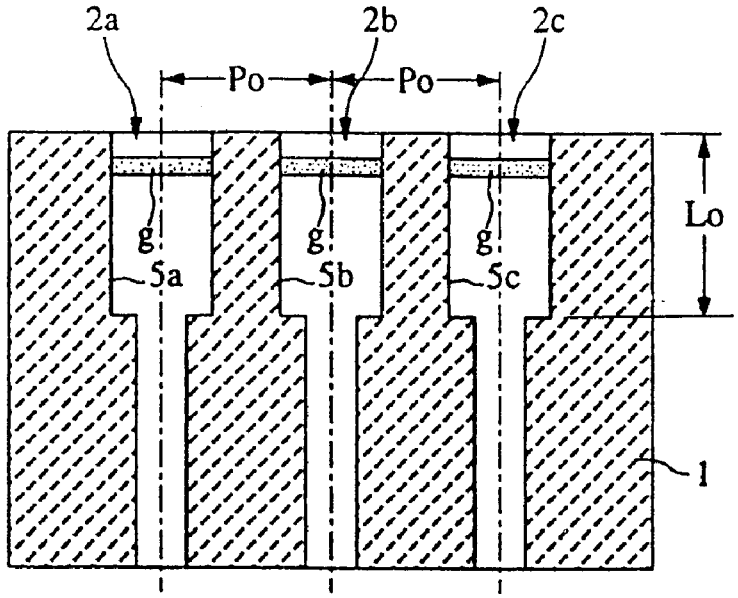
FIG. 9A PRIOR ART
FIGS. 9A and 9B is sectional views showing a state of setting for coupling of the prior art dielectric filter.
Figure 9B:
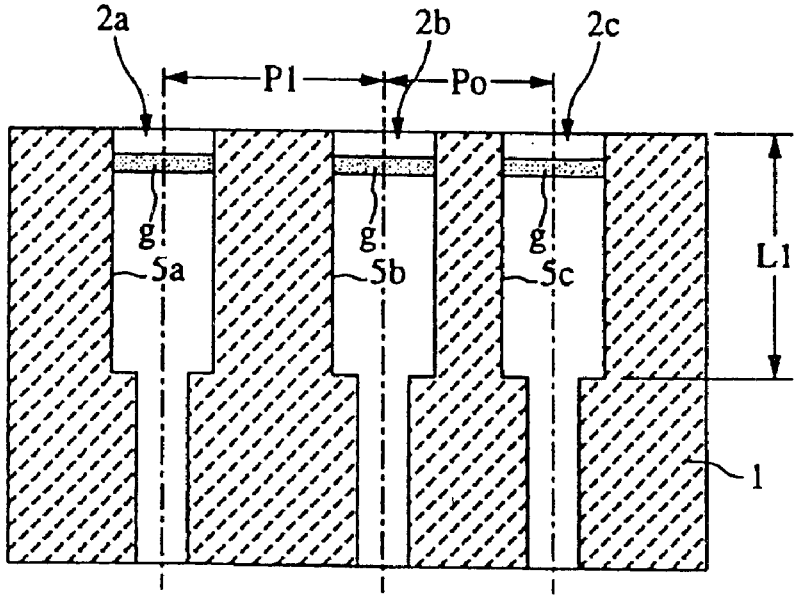
FIG. 9B PRIOR ART

Referring to FIGS. 5A and 5B, a structure of a dielectric filter according to a fifth preferred embodiment will be described.

In the dielectric filter shown in FIGS. 1A and 1B, the surface (step surface) of the part where the inner diameter of the resonance-line hole turns into a step form is parallel to the end face of the dielectric block, which the resonance-line hole passes through. In contrast, in an embodiment shown in FIGS. 5A and 5B, the step surface is set to be inclined to the end face of the dielectric block. As shown in FIG. 5B, in such a case, although the pitch Po for aligning the resonance-line holes 2*a*–2*b*–2*c* is uniform, the capacitive coupling between the resonance lines 5*a*–5*b* increases, whereas the capacitive coupling between the resonance lines 5*b*–5*c* decreases.

Next, a structure of a duplexer (an antenna duplexer) according to a sixth preferred embodiment will be described referring to FIG. 6. In this embodiment, resonance-line holes indicated by 2*a*, 2*b*, 2*c*, 2*d*, 2*e*, 2*f* and 2*g* are respectively provided in the dielectric block 1, and on the inner surface thereof, a resonance line is provided. The terminal electrodes 6, 7, and 8, and the ground electrode 3, are provided on an outer surface of the dielectric block 1. The structure of the resonance-line holes and the resonance lines is the same as those shown in FIGS. 1A and 1B. The resonance-line holes 2*a*, 2*b* and 2*c* form a transmission filter having a band pass characteristic of three-stage resonators. Additionally, the resonance-line holes 2*e*, 2*f*, and 2*g* form a reception filter having a band pass characteristic of three-stage resonators.

The resonance line on the inner surface of the resonance-line hole 2*d* serves as a coupling resonator which makes a coupling to 2*c* and 2*e*, respectively. A ground electrode 8 is electrically connected to the resonance line formed on the inner surface of the resonance-line hole 2*d*. The terminal electrodes 6 and 7 make a capacitive coupling to the resonance lines formed on the inner surfaces of the resonance-line holes 2*a* and 2*g*. This arrangement provides a duplexer used as an antenna duplexer, in which the terminal electrode 6 is used as an input terminal of transmission signals, the terminal electrode 7 is used as an output terminal of reception signals, and the terminal electrode 8 is used as an antenna connection terminal.

Next, a structure of a communication apparatus using the dielectric filter or the duplexer described above will be illustrated referring to FIG. 7. In this figure, ANT indicates a transmission-reception antenna, DXP indicates a duplexer, BPFa, BPFb, and BPFc respectively indicate band pass filters, AMPa and AMPb respectively indicate amplification circuits, MIXa and MIXb respectively indicate mixers, OSC indicates an oscillator, and DIV is a frequency divider (synthesizer). MIXa modulates the frequency signals output from DIV by modulation signals. BPFa passes only signals of the band of a transmission frequency, and AMPa performs power-amplification of the signals to transmit from ANT through DPX. BPFb passes only signals of the reception-frequency band among the signals output from DPX, and AMPb amplifies the signals. MlXb performs mixing of the frequency signals output from BPFc and the reception signals to output intermediate frequency signals IF.

As for the duplexer DPX shown in FIG. 7, the duplexer of the structure shown in FIG. 6 can be used. In addition, as the band pass filters BPFa, BPFb, and BPFc, the dielectric filter of the structure shown in FIGS. 1A, 1B, 2, 3, 4A, 4B, 5A and 5B can be used. In this way, an overall compact communication apparatus can be formed.

While the invention has been particularly shown and described with reference to preferred embodiments thereof, it will be understood by those skilled in the art that the forgoing and other changes in form and details may be made therein without departing from the spirit of the invention.

What is claimed is:

1. A dielectric filter comprising:

a dielectric block;

a plurality of resonance-line holes aligned therein;

a respective resonance line disposed on an inner surface of each of the resonance-line holes;

an outer conductor disposed on an outer surface of the dielectric block;

wherein one end of each of the resonance-line holes is a short-circuit end;

a respective sectional area of at least one of the resonance-line holes is changed at a corresponding predetermined portion; and the respective predetermined portion of the at least one of the resonance-line holes is disposed at a different position along an axial direction of said at least one of the resonance-line holes on a first side thereof which faces toward an adjacent resonance-line hole, than on a second side thereof which faces away from said adjacent resonance-line hole.

2. The dielectric filter according to claim 1, wherein a pitch for aligning the at least one resonance-line hole is substantially uniform.

3. A dielectric filter comprising:

a dielectric block;

a plurality of resonance-line holes aligned therein;

a respective resonance line disposed on an inner surface of each of the resonance-line holes;

an outer conductor disposed on an outer surface of the dielectric block;

wherein one end of each of the resonance-line holes is a short-circuit end;

a respective sectional area of at least one of the resonance-line holes is changed at a corresponding predetermined portion;

the respective predetermined portion of the at least one of the resonance-line holes is disposed at a different position along an axial direction of said at least one of the resonance-line holes on a first side thereof which faces toward an adjacent resonance-line hole, than on a second side thereof which faces away from said adjacent resonance-line hole; and wherein the predetermined portion where the respective sectional area of the at least one resonance-line hole is changed is inclined to the axial direction of the at least one resonance-line hole.

4. A dielectric filter comprising:

a dielectric block;

a plurality of resonance-line holes aligned therein;

a respective resonance line disposed on an inner surface of each of the resonance-line holes;

an outer conductor disposed on an outer surface of the dielectric block;

wherein one end of each of the resonance-line holes is a short-circuit end;

a respective sectional area of at least one of the resonance-line holes is changed at a corresponding predetermined portion;

the respective predetermined portion of the at least one of the resonance-line holes is disposed at a different position along an axial direction of said at least one of the resonance-line holes on a first side thereof which faces toward an adjacent resonance-line hole, than on a second side thereof which faces away from said adjacent resonance-line hole;

wherein a pitch for aligning the resonance-line holes is substantially uniform; and wherein the predetermined portion where the sectional area of the at least one resonance-line hole is changed is inclined to the axial direction of the at least one resonance-line hole.

5. A composite dielectric filter comprising:

a dielectric block;

a plurality of resonance-line holes aligned therein;

a respective resonance line disposed on an inner surface of each of the resonance-line holes;

an outer conductor disposed on an outer surface of the dielectric block;

wherein one end of each of the resonance-line holes is a short-circuit end;

a respective sectional area of at least one of the resonance-line holes is changed at a corresponding predetermined portion;

the respective predetermined portion of the at least one of the resonance-line holes is disposed at a different position along an axial direction of said at least one of the resonance-line holes on a first side thereof which faces toward an adjacent resonance-line hole, than on a second side thereof which faces away from said adjacent resonance-line hole; and three or more signal input-output terminals disposed on said dielectric block for performing input and output of signals by coupling to corresponding ones of the plurality of resonance lines.

6. A composite dielectric filter according to claim 5, wherein a pitch for aligning the at least one resonance-line hole is substantially uniform.

7. A composite dielectric filter comprising:

a dielectric block;

a plurality of resonance-line holes aligned therein;

a respective resonance line disposed on an inner surface of each of the resonance-line holes;

an outer conductor disposed on an outer surface of the dielectric block;

wherein one end of each of the resonance-line holes is a short-circuit end;

a respective sectional area of at least one of the resonance-line holes is changed at a corresponding predetermined portion;

the respective predetermined portion of the at least one of the resonance-line holes is disposed at a different position along an axial direction of said at least one of the resonance-line holes on a first side thereof which faces toward an adjacent resonance-line hole, than on a second side thereof which faces away from said adjacent resonance-line hole;

wherein the predetermined portion where the respective sectional area of the at least one resonance-line hole is changed is inclined to the axial direction of the at least one resonance-line hole; and three or more signal input-output terminals disposed on said dielectric block for performing input and output of signals by coupling to corresponding ones of the plurality of resonance lines.

8. A composite dielectric filter comprising:

a dielectric block;

a plurality of resonance-line holes aligned therein;

a respective resonance line disposed on an inner surface of each of the resonance-line holes;

an outer conductor disposed on an outer surface of the dielectric block;

wherein one end of each of the resonance-line holes is a short-circuit end;

a respective sectional area of at least one of the resonance-line holes is changed at a corresponding predetermined portion;

the respective predetermined portion of the at least one of the resonance-line holes is disposed at a different position along an axial direction of said at least one of the resonance-line holes on a first side thereof which faces toward an adjacent resonance-line hole, than on a second side thereof which faces away from said adjacent resonance-line hole;

wherein a pitch for aligning the resonance-line holes is substantially uniform;

wherein the predetermined portion where the respective sectional area of the at least one resonance-line hole is changed is inclined to the axial direction of the at least one resonance-line hole; and three or more signal input-output terminals disposed on said dielectric block for performing input and output of signals by coupling to corresponding ones of the plurality of resonance lines.

9. A duplexer comprising:

a transmission filter and a reception filter, at least one of said transmission filter and reception filter comprising a dielectric filter which comprises:

a dielectric block;

a plurality of resonance-line holes aligned therein;

a respective resonance line disposed on an inner surface of each of the resonance-line holes;

an outer conductor disposed on an outer surface of the dielectric block;

wherein one end of each of the resonance-line holes is a short-circuit end;

a respective sectional area of at least one of the resonance-line holes is changed at a corresponding predetermined portion; and the respective predetermined portion of the at least one of the resonance-line holes is disposed at a different position along an axial direction of said at least one of the resonance-line holes on a first side thereof which faces toward an adjacent resonance-line hole, than on a second side thereof which faces away from said adjacent resonance-line hole.

10. A duplexer according to claim 9, wherein a pitch for aligning the at least one resonance-line hole is substantially uniform.

11. A duplexer comprising:

a transmission filter and a reception filter, at least one of said transmission filter and reception filter comprising a dielectric filter which comprises:

a dielectric block;

a plurality of resonance-line holes aligned therein;

a respective resonance line disposed on an inner surface of each of the resonance-line holes;

an outer conductor disposed on an outer surface of the dielectric block;

wherein one end of each of the resonance-line holes is a short-circuit end;

a respective sectional area of at least one of the resonance-line holes is changed at a corresponding predetermined portion;

the respective predetermined portion of the at least one of the resonance-line holes is disposed at a different position along an axial direction of said at least one of the resonance-line holes on a first side thereof which faces toward an adjacent resonance-line hole, than on a second side thereof which faces away from said adjacent resonance-line hole; and wherein the predetermined portion where the respective sectional area of the at least one resonance-line hole is changed is inclined to the axial direction of the at least one resonance-line hole.

12. A duplexer comprising:

a transmission filter and a reception filter, at least one of said transmission filter and reception filter comprising a dielectric filter which comprises:

a dielectric block;

a plurality of resonance-line holes aligned therein;

a respective resonance line disposed on an inner surface of each of the resonance-line holes;

an outer conductor disposed on an outer surface of the dielectric block;

wherein one end of each of the resonance-line holes is a short-circuit end;

a respective sectional area of at least one of the resonance-line holes is changed at a corresponding predetermined portion;

the respective predetermined portion of the at least one of the resonance-line holes is disposed at a different position along an axial direction of said at least one of the resonance-line holes on a first side thereof which faces toward an adjacent resonance-line hole, than on a second side thereof which faces away from said adjacent resonance-line hole;

wherein a pitch for aligning the resonance-line holes is substantially uniform; and wherein the predetermined portion where the respective sectional area of the at least one resonance-line hole is changed is inclined to the axial direction of the at least one resonance-line hole.

13. A duplexer comprising:

a transmission filter and a reception filter, at least one of said transmission filter and reception filter comprising a composite dielectric filter which comprises:

a dielectric block;

a plurality of resonance-line holes aligned therein;

a respective resonance line disposed on an inner surface of each of the resonance-line holes;

an outer conductor disposed on an outer surface of the dielectric block;

wherein one end of each of the resonance-line holes is a short-circuit end;

a respective sectional area of at least one of the resonance-line holes is changed at a corresponding predetermined portion;

the respective predetermined portion of the at least one of the resonance-line holes is disposed at a different position along an axial direction of said at least one of the resonance-line holes on a first side thereof which faces toward an adjacent resonance-line hole, than on a second side thereof which faces away from said adjacent resonance-line hole; and three or more signal input-output terminals disposed on said dielectric block for performing input and output of signals by coupling to corresponding ones of the plurality of resonance lines.

14. A duplexer according to claim 13, wherein a pitch for aligning the at least one resonance-line hole is substantially uniform.

15. A duplexer comprising:

a transmission filter and a reception filter, at least one of said transmission filter and reception filter comprising a composite dielectric filter which comprises:

a dielectric block;

a plurality of resonance-line holes aligned therein;

a respective resonance line disposed on an inner surface of each of the resonance-line holes;

an outer conductor disposed on an outer surface of the dielectric block;

wherein one end of each of the resonance-line holes is a short-circuit end;

a respective sectional area of at least one of the resonance-line holes is changed at a corresponding predetermined portion;

the respective predetermined portion of the at least one of the resonance-line holes is disposed at a different position along an axial direction of said at least one of the resonance-line holes on a first side thereof which faces toward an adjacent resonance-line hole, than on a second side thereof which faces away from said adjacent resonance-line hole;

three or more signal input-output terminals disposed on said dielectric block for performing input and output of signals by coupling to corresponding ones of the plurality of resonance lines; and wherein the predetermined portion where the sectional area of the at least one resonance-line hole is changed is inclined to the axial direction of the at least one resonance-line hole.

16. A duplexer comprising:

a transmission filter and a reception filter, at least one of said transmission filter and reception filter comprising a composite dielectric filter which comprises:

a dielectric block;

a plurality of resonance-line holes aligned therein;

a respective resonance line disposed on an inner surface of each of the resonance-line holes;

an outer conductor disposed on an outer surface of the dielectric block;

wherein one end of each of the resonance-line holes is a short-circuit end;

a respective sectional area of at least one of the resonance-line holes is changed at a corresponding predetermined portion;

the respective predetermined portion of the at least one of the resonance-line holes is disposed at a different position along an axial direction of said at least one of the resonance-line holes on a first side thereof which faces toward an adjacent resonance-line hole, than on a second side thereof which faces away from said adjacent resonance-line hole;

three or more signal input-output terminals disposed on said dielectric block for performing input and output of signals by coupling to corresponding ones of the plurality of resonance lines; and wherein a pitch for aligning the resonance-line holes is substantially uniform; and wherein the predetermined portion where the sectional area of the at least one resonance-line hole is changed is inclined to the axial direction of the at least one resonance-line hole.

17. A communication apparatus, comprising a high-frequency circuit section, and disposed therein, a dielectric filter comprising:

a dielectric block;

a plurality of resonance-line holes aligned therein;

a respective resonance line disposed on an inner surface of each of the resonance-line holes;

an outer conductor disposed on an outer surface of the dielectric block;

wherein one end of each of the resonance-line holes is a short-circuit end;

a respective sectional area of at least one of the resonance-line holes is changed at a corresponding predetermined portion; and the respective predetermined portion of the at least one of the resonance-line holes is disposed at a different position along an axial direction of said at least one of the resonance-line holes on a first side thereof which faces toward an adjacent resonance-line hole, than on a second side thereof which faces away from said adjacent resonance-line hole.

18. A communication apparatus according to claim 17, wherein a pitch for aligning the at least one resonance-lines hole is substantially uniform.

19. A communication apparatus, comprising a high-frequency circuit section, and disposed therein, a dielectric filter comprising:

a dielectric block;

a plurality of resonance-line holes aligned therein;

a respective resonance line disposed on an inner surface of each of the resonance-line holes;

an outer conductor disposed on an outer surface of the dielectric block;

wherein one end of each of the resonance-line holes is a short-circuit end;

a respective sectional area of at least one of the resonance-line holes is changed at a corresponding predetermined portion;

the respective predetermined portion of the at least one of the resonance-line holes is disposed at a different position along an axial direction of said at least one of the resonance-line holes on a first side thereof which faces toward an adjacent resonance-line hole, than on a second side thereof which faces away from said adjacent resonance-line hole; and wherein the predetermined portion where the respective sectional area of the at least one resonance-line hole is changed is inclined to the axial direction of the at least one resonance-line hole.

20. A communication apparatus, comprising a high-frequency circuit section, and disposed therein, a dielectric filter comprising:

a dielectric block;

a plurality of resonance-line holes aligned therein;

a respective resonance line disposed on an inner surface of each of the resonance-line holes;

an outer conductor disposed on an outer surface of the dielectric block;

wherein one end of each of the resonance-line holes is a short-circuit end;

a respective sectional area of at least one of the resonance-line holes is changed at a corresponding predetermined portion;

the respective predetermined portion of the at least one of the resonance-line holes is disposed at a different position along an axial direction of said at least one of the resonance-line holes on a first side thereof which faces toward an adjacent resonance-line hole, than on a second side thereof which faces away from said adjacent resonance-line hole;

wherein a pitch for aligning the resonance-line holes is substantially uniform; and wherein the predetermined portion where the respective sectional area of the at least one resonance-line hole is changed is inclined to the axial direction of the at least one resonance-line hole.

* * * * *